US009815296B2

(12) United States Patent
Mueller et al.

(10) Patent No.: US 9,815,296 B2
(45) Date of Patent: Nov. 14, 2017

(54) METHOD FOR CONTROLLING THE TEMPERATURE OF A SHEET IN A PRINTING MACHINE

(71) Applicant: HEIDELBERGER DRUCKMASCHINEN AG, Heidelberg (DE)

(72) Inventors: Andreas Mueller, Heidelberg (DE); Alexander Knabe, Heidelberg (DE); Rolf Mueller, Nussloch (DE); Kai Oskar Mueller, Birkenau (DE); Peter Hachmann, Weinheim-Hohensachsen (DE); Michael Gieser, Oftersheim (DE); Wolfgang Dolz, Heidelberg (DE); Thomas Schmidt, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 15/279,764

(22) Filed: Sep. 29, 2016

(65) Prior Publication Data

US 2017/0136794 A1 May 18, 2017

(30) Foreign Application Priority Data

Nov. 18, 2015 (DE) ..... 10 2015 222 718

(51) Int. Cl.

| | |
|---|---|
| ***B41J 2/355*** | (2006.01) |
| ***B41J 2/42*** | (2006.01) |
| *B41J 2/01* | (2006.01) |
| *B41J 11/00* | (2006.01) |

(52) U.S. Cl.

CPC ..... *B41J 2/355* (2013.01); *B41J 2/42* (2013.01); *B41J 2/01* (2013.01); *B41J 11/002* (2013.01)

(58) Field of Classification Search

CPC . B41J 11/002; B41J 29/377; B41J 2/01; B41J 2/355; B41J 2/42; B41J 2002/14177

See application file for complete search history.

(56) References Cited

U.S. PATENT DOCUMENTS 6,401,358 B1 * 6/2002 Bar ..... F26B 3/283 34/266
6,877,247 B1 * 4/2005 DeMoore ..... F26B 3/283 101/419

FOREIGN PATENT DOCUMENTS

| | | | |
|---|---|---|---|
| DE | 3642204 | A1 | 6/1987 |
| DE | 102007040139 | A1 | 4/2008 |
| WO | 0216139 | A1 | 2/2002 |

* cited by examiner

*Primary Examiner* — Sharon A Polk

(74) *Attorney, Agent, or Firm* — Laurence A. Greenberg; Werner H. Stemer; Ralph E. Locher

(57) ABSTRACT

A method for controlling the temperature of a sheet in a printing machine includes measuring initial temperatures in zones on the sheet. Segments of an emitter are actuated in different ways as a function of the measured initial temperatures for irradiating cooler zones to a greater extent and warmer zones to a lesser extent or not at all. A common final temperature or at least a homogenization of the temperature is therefore achieved in the zones.

10 Claims, 3 Drawing Sheets

METHOD FOR CONTROLLING THE TEMPERATURE OF A SHEET IN A PRINTING MACHINE

CROSS-REFERENCE TO RELATED APPLICATION

This application claims the priority, under 35 U.S.C. §119, of German Patent Application DE 10 2015 222 718.9, filed Nov. 18, 2015; the prior application is herewith incorporated by reference in its entirety.

BACKGROUND OF THE INVENTION

Field of the Invention

The present invention relates to a method for controlling the temperature of a sheet in a printing machine.

German Patent Application DE 36 42 204 A1 discloses an inkjet writer which includes a heating device that is suitable for heating up different recording media to different temperatures. The heating device is formed of a minimum of two types of heating elements that generate thermal energy for different temperatures. The different types of heating elements may be selectively controlled as a function of whether the recording medium is transparent or not. If the recording medium is an opaque recording medium, for instance wood-free paper, the record surface of the recording medium is heated to approximately 100° Celsius to 140° Celsius during the printing operation. If the recording medium is a transparency, it is heated to between approximately 80° Celsius and 100° Celsius. The process switches between the heating elements of the heating device, allowing the power consumption of the heating device to be reduced. The recording medium is in sliding contact with a counterpressure plate, which is heated by the heating elements. Thus the recording medium is heated to the predefined temperature before and after receiving emitted ink droplets.

SUMMARY OF THE INVENTION

It is accordingly an object of the invention to provide a method for controlling the temperature of a sheet in a printing machine, which overcomes the hereinafore-mentioned disadvantages of the heretofore-known methods of this general type and which is suitable for processing badly acclimatized sheets.

With the foregoing and other objects in view there is provided, in accordance with the invention, a method for controlling the temperature of a sheet in a printing machine, which includes the steps of measuring initial temperatures in a plurality of zones on the sheet and actuating segments of an emitter in different ways as a function of the measured initial temperatures to irradiate cooler zones of the plurality of zones to a greater extent and warmer zones of the plurality of zones to a lesser extent or not at all in order to obtain a common final temperature in the plurality of zones or at least a homogenization of the temperature.

In accordance with the method of the invention, cooler places on the sheet are heated to a greater extent than warmer places instead of applying a constant temperature to the entire surface of the sheet. This allows the distribution of heat in the sheet to be homogenized. This is a very advantageous feature if water-based inks are used to print on the sheet. Such inks are very sensitive to temperature differences in the sheet. Thus it is an advantage that the method of the invention provides a largely uniform sheet temperature over the entire surface to be printed on.

In order to provide a high-quality printing operation, this sheet temperature is adapted to the temperature of the jetting cylinder or endless jetting belt that supports the sheet during the printing operation. The use of one or more emitters in the method of the invention allows temperature differences in a sheet or between sheets that may result from too short an acclimatization to be efficiently homogenized.

Various further developments of the method of the invention are possible.

The power of the emitter may be controlled in accordance with the measured sheet temperatures to obtain a homogeneous sheet temperature (final temperature) after the temperature control process. For this purpose, prior to the temperature control process, the sheet temperatures (initial temperatures) may be recorded by using one or more infrared cameras or any other suitable type of sensor system, e.g. an infrared pyrometer, and the power of the emitter may be controlled in zones as the sheet passes through the temperature control zone so that having passed the emitter, the sheet has a uniform final temperature. In this way, temperature differences in the sheet extending in the direction of sheet transport may be registered and compensated for.

A first sensor system and a second sensor system may be jointly used for control purposes. In this process, the initial actuation of the emitter may occur as a function of information from the first sensor system, the thickness of the sheets, the thermal capacity of the sheets, the thermal conductivity of the sheets, and other known parameters such as a potential pretreatment of the sheets. Such a pretreatment may be a primer coating of the sheets and may have occurred prior to the recording/measurement by the first sensor system or between the first sensor system and the downstream emitter. With the aid of the second sensor system, which is disposed downstream of the first emitter, the latter may be adapted to minimize the remaining deviation from a target value on the basis of the measured temperature. The control parameters that result in a steady state of the control loop for the respective substrate may be saved in a control unit or in a job-specific mobile data memory and may be accessed in the case of a follow-up order to reduce waste.

The emitter(s) may be infrared emitters. In order to obtain a quicker response, the emitter(s) may be LED lamps.

If a number of sensors or cameras are directed to the passing sheet in parallel, the first sensor system and/or the second sensor system may measure the temperature not only in the direction of sheet transport but also in a direction transverse to the direction of sheet transport. In this case, the emitter is subdivided into subsegments in a direction transverse to the direction of sheet transport and the subsegments are actuated in the corresponding sheet zones in accordance with the sheet temperatures. In this way, temperature fluctuations in a direction transverse to the direction of sheet transport may likewise be compensated for and better homogenization of the sheet temperature may be achieved. For such a two-dimensional temperature control it is advantageous to use an LED lamp subdivided into individual LED units that may be actuated individually.

Other features which are considered as characteristic for the invention are set forth in the appended claims.

Although the invention is illustrated and described herein as embodied in a method for controlling the temperature of a sheet in a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
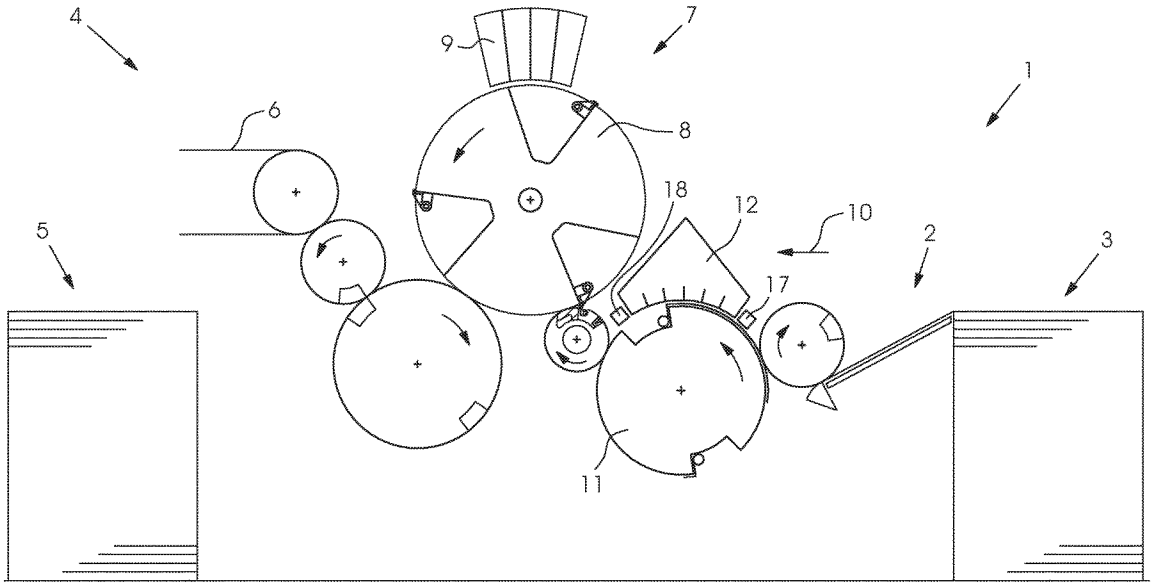
FIG. 1 is a diagrammatic, longitudinal-sectional view of a printing machine in which the method of the invention is carried out.

Referring now to the figures of the drawings in detail and first, particularly, to FIG. 1 thereof, there is seen a printing machine 1 in which the method of the invention is carried out. The printing machine 1 is a sheet-fed printing machine for digital printing including a sheet feeder 2 with a feeder sheet stack 3, a sheet delivery 4 with a delivery sheet stack 5, and a chain conveyor 6 for delivering the sheets to the delivery sheet stack 5. The machine further includes an inkjet printing unit 7 including a jetting cylinder 8 for transporting the sheets past inkjet print heads 9. A sheet-transporting drum 11 is disposed upstream of the jetting cylinder 8 as viewed in the direction of sheet transport 10. An endless transport belt may be used instead of the jetting cylinder 8 for transporting the sheets during the printing operation.

Figure 2:
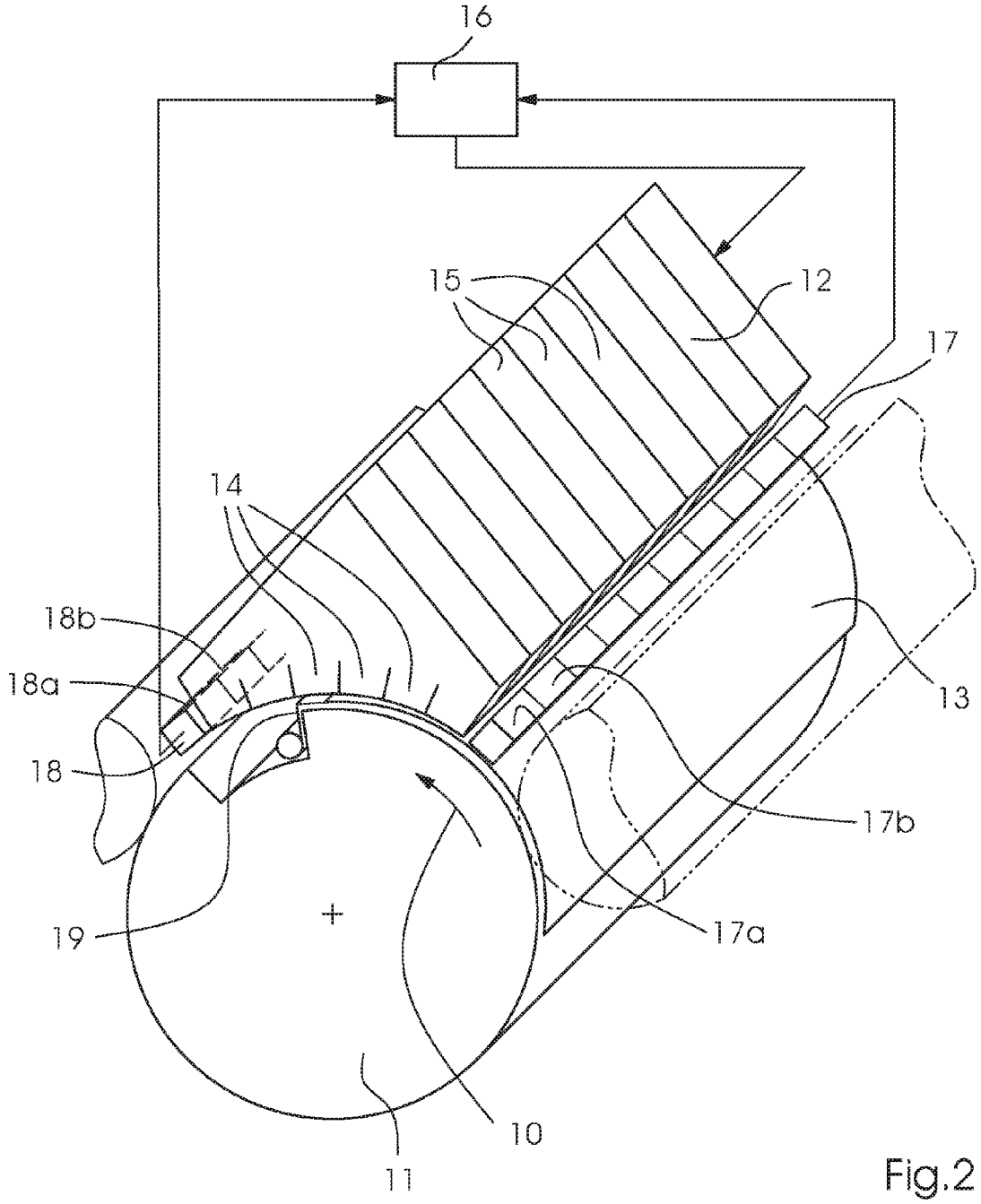
FIG. 2 is an enlarged perspective view of a sheet-transporting drum in the printing machine as well as two sensor systems and an emitter provided therebetween and directed to the sheet-transporting drum.

FIG. 2 shows the sheet-transporting drum 11 and an emitter 12 for heating a sheet 13 on the sheet-transporting drum 11 for temperature control purposes. The emitter 12 is subdivided into a row of segments 14 extending along the circumference of the drum. Every segment 14 may be formed of a tube for emitting IR radiation or of a row of LED. A control device 16 may actuate every segment 14 individually in terms of its radiation power and its active phase.

The radiation power, for instance, depends on the thickness of the sheets 13 used in the respective print job. The thickness of the sheets is entered or saved in the control unit 16. The radiation power may also depend on further parameters that are entered or saved in the control unit 16, for instance if and how the sheets 13 have been pretreated.

The active phase, which is the period of time between switching the respective segment 14 on and off, for instance depends on the machine speed of the printing machine 1. The control unit 16 may receive information on the current machine speed or the sheet transport frequency (sheet cycle) from a sensor.

A first sensor system 17 is disposed upstream of the emitter 12 as viewed in the direction of sheet transport 10 (which is the direction of rotation of the drum in the illustrated example), and a second sensor system 18 is disposed downstream of the emitter 12 as viewed in the direction of sheet transport 10. The sensor systems 17, 18 may be thermal imaging cameras or infrared pyrometers. The first sensor system 17 measures the temperature of the sheet 13 in its imaginary zones X1 and X6.

Figure 3A:
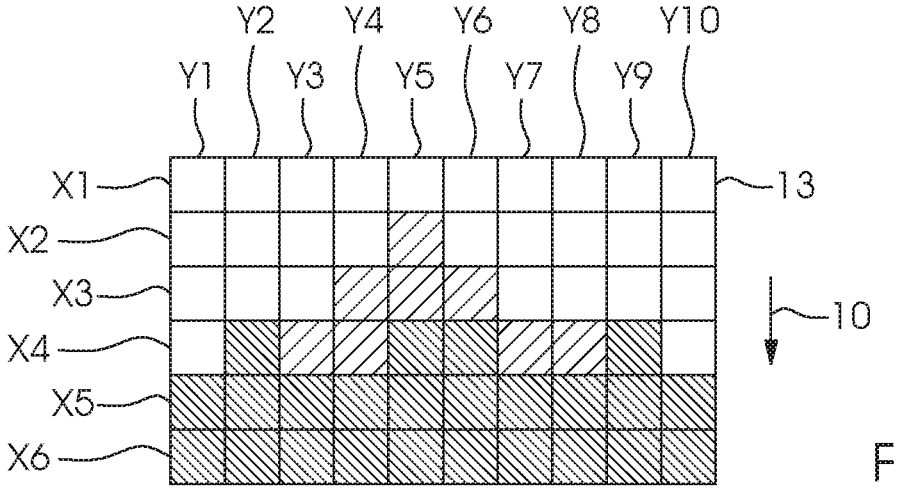
FIG. 3A is a plan view illustrating the temperature distribution in a sheet before it has been heated by the emitter.

FIG. 3A shows that every zone X1 to X6 has the shape of a stripe that is perpendicular to the direction of sheet transport 10 and extends over the entire width of the sheet. Zones X1 to X6 of the sheet 13 may have different temperatures. For instance, zones X1 to X6 may get warmer the closer they are to the leading edge of the sheet 13, which is held in a gripper system 19 of the sheet-transporting drum 11. A further sheet-transporting drum that likewise has a gripper system for holding the leading edge of the sheet may be provided upstream of the sheet-transporting drum 11 as viewed in the direction of sheet transport 10. As the distance to the gripper system of the further sheet-transporting drum increases (i.e. the greater the sheet length), the sheet 13 will wrap less and less closely around the circumferential surface of the further sheet-transporting drum, resulting in less and less heat being transferred from the further sheet-transporting drum to the sheet 13 from the leading edge of the sheet to the trailing edge of the sheet, i.e. from zone X6 to zone X1. Due to the fact that heat sources are disposed in the immediate surroundings of the further sheet-transporting drum and will (inevitably) heat the latter, the further sheet-transporting drum has a higher temperature than the sheet 13, causing the transfer of heat as described above. Thus, when the sheet 13 is transferred from the further sheet-transporting drum to sheet-transporting drum 11, zones X1 to X6 have different temperatures.

As the sheet 13 passes, the first sensor system 17 successively measures the initial temperatures of zones X1 to X6, which are disposed behind one another as viewed in the direction of sheet transport 10. Then the control unit 16 actuates the segments 14 as a function of the different measured initial temperatures of zones X1 to X6 in such a way that the cooler zones (e.g. X1 to X3) are irradiated (and thus heated) to a greater extent and the warmer zones (e.g. X4 to X6) are irradiated (and thus heated) to a lesser extent. The emitter 12 thus applies a negative or inverse temperature profile to the sheet 13 with respect to the initial temperature profile of the sheet 13.

The control unit 16 successively actuates the segments 14 in terms of their radiation power as required for each zone X1 to X6 in such a way as to obtain a common final temperature for all zones X1 to X6 or at least a more homogeneous temperature in these zones X1 to X6. For instance, zone X1 needs particularly intensive irradiation, causing the respective segment 14 to be powered to the maximum. In this case the segments 14 are successively powered to the maximum, starting at the last segment 14 as viewed in the direction of sheet transport 10, as soon as zone X1 is in the target region of the respective segment 14. In a manner of speaking, the irradiation corresponding to maximum power moves along with zone X1 from segment 14 to segment 14.

The second sensor system 18 measures the final temperature that has been attained in each zone X1 to X6 and signals it to the control unit 16. The control unit 16 compares the final temperatures it has received to a saved target value to control the emitter 12. If the measured final temperature (actual value) in a zone X1 to X6 deviates too much from the predefined target value, the control unit 16 actuates the segments 14 in such a way as to approximate the final temperature in the relevant zone X1 to X6 to the target value in the following sheets 13.

FIG. 3A shows a sheet 13 subdivided into a number of imaginary zones Y1 to Y10 shaped like stripes that extend in a direction parallel to the direction of sheet transport 10. A matrix (checkered pattern) of rectangular zones X1Y1 to X6Y10 is the result in the intersections of zones X1 to X6 (transverse stripes/lines) and zones Y1 to Y10 (longitudinal stripes/columns).

The first sensor system 17 may be subdivided into a row of subsystems 17*a*, 17*b* and the second system 18 may be subdivided into a row of subsystems 18*a*, 18*b*. Both rows of subsystems extend in a direction transverse to the direction of sheet transport 10 and consequently parallel to the axis of rotation of the sheet-transporting drum 11. The number of subsystems 17*a*, 17*b* of the first sensor system 17 corresponds to the number of zones Y1 to Y10 and each one of the subsystems 18*a*, 18*b* of the second sensor system 18 is likewise assigned to a different one of zones Y1 to Y10. Thus the first sensor system 17 is capable of measuring the initial temperature of every one of the rectangular zones X1Y1 to X6Y10.

Figure 3B:
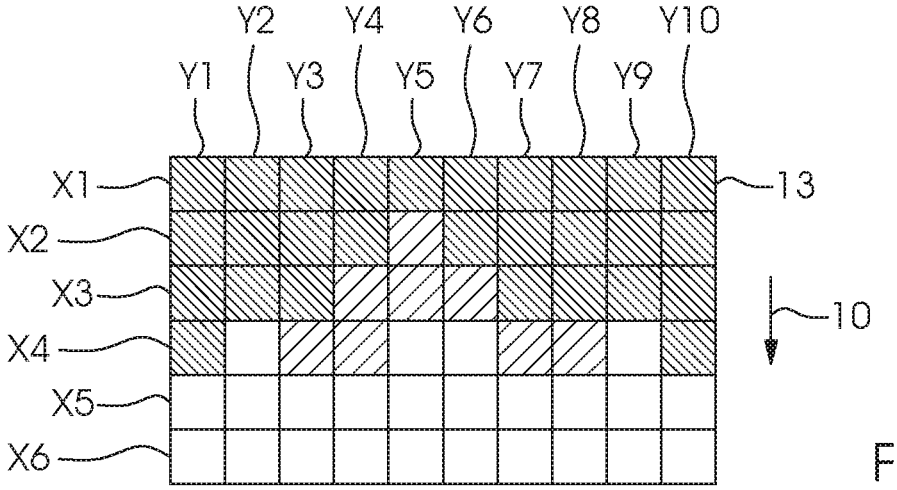
FIG. 3B is a plan view illustrating the distribution of the power of the lamp on the sheet.
Figure 3C:
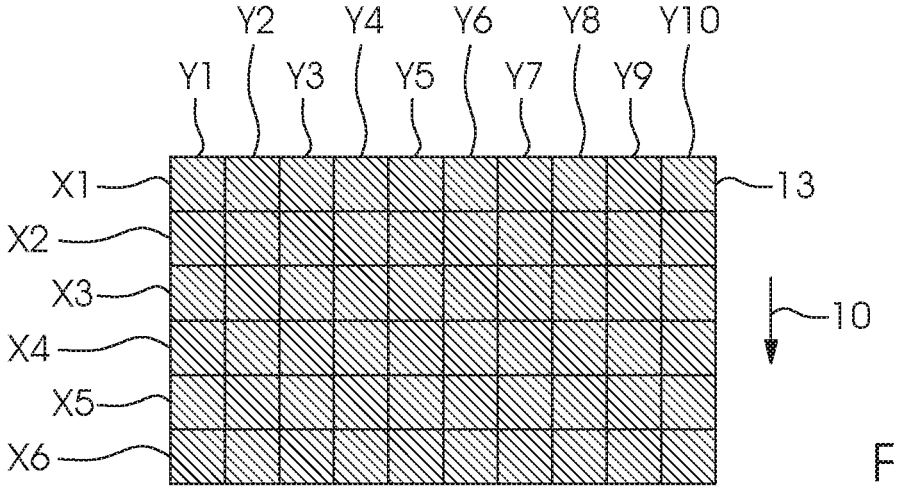
FIG. 3C is a plan view illustrating the temperature distribution on the sheet after it has been heated.

Every segment 14 of the emitter 12 is subdivided into a row of subsegments 15, each of which corresponds to a different one of zones Y1 to Y10. Every subsegment 15 includes one or more light-emitting diodes (LED) for locally heating the sheet 13. The control unit 16 individually controls the subsegments 15 to create a zonally or locally individualized temperature in the rectangular zones X1Y1 to X6Y10 of the sheet 13 as is diagrammatically shown in FIG. 3B. The actuation of the subsegments 15 occurs as a function of the initial temperatures measured by the first sensor system 17 in the zones X1Y1 to X6Y10, striving to provide a common final temperature corresponding to the target value in all zones X1Y1 to X6Y10 as diagrammatically shown in FIG. 3C.

Immediately after the heating process, the second sensor system 18 measures the actual final temperatures (actual values) of zones X1Y1 to X6Y10 to reactuate the subsegments 15 based on a comparison between actual and target values by the control unit 16.

The two-dimensional temperature measurement and two-dimensional thermal control is particularly advantageous for sheets 13 that have a cooler central region and warmer marginal regions disposed in rings around the central region. Such sheets may be the result if the sheets in the feeder stack 3 are not given enough time to acclimatize. If the stack is moved into the air-conditioned print shop from a delivery truck or storage area, the temperature of the feeder stack 3 may be much below the room temperature of the print shop. During the acclimatization period, the feeder stack 5 in the print shop heats up from the outside to the inside. If the acclimatization period is too short, the feeder stack 5 has a cold core when the printing operation starts and the sheets located in the center of the feeder stack 5 have a cooler central region. A homogenization of the sheet temperature improves the printing conditions for an inkjet printing process that occurs immediately after the temperature homogenization process. The ink used in inkjet printing is very temperature-sensitive in terms of its viscosity and would be absorbed into the sheet 13 more quickly in warmer sheet zones than in cooler sheet zones if no countermeasures as proposed by the invention were taken.

Due to these measures, shorter acclimatization periods are necessary and print jobs may be completed in less time, increasing productivity.

The invention claimed is:

1. A method for controlling the temperature of a sheet in a printing machine, the method comprising the following steps:

measuring initial temperatures in zones of the sheet before irradiating; and individually actuating segments of an emitter as a function of the initial temperatures measured before irradiating to irradiate cooler zones to a greater extent and warmer zones to a lesser extent or not at all to attain a common final temperature or at least a homogenization of the temperature in the zones.

2. The method according to claim 1, which further comprises carrying out the measurement of the sheet temperature and the temperature homogenization in the sheet two-dimensionally.

3. The method according to claim 1, which further comprises using the emitter to apply a negative or inverse radiation power profile to the sheet relative to an initial temperature profile of the sheet.

4. The method according to claim 1, which further comprises subdividing the emitter into a row of segments extending along a circumference of a sheet-transporting drum of the printing machine.

5. The method according to claim 4, which further comprises using a control unit to individually actuate every segment in terms of its radiation power and activation phase.

6. The method according to claim 5, which further comprises subdividing every segment into a respective row of subsegments.

7. The method according to claim 6, which further comprises actuating the subsegments in accordance with an actual value versus target value comparison by the control unit.

8. The method according to claim 1, which further comprises using a first sensor system to successively measure the initial temperatures of the zones disposed behind one another in a sheet transport direction.

9. The method according to claim 8, which further comprises forming the zones into a checkered pattern of rectangular zones, and using the first sensor system to measure the initial temperature in each one of the rectangular zones.

10. The method according to claim 8, which further comprises using a second sensor system to measure the attained final temperature in each zone.

* * * * *